United States Patent [19]

Sorenson

[11] 4,242,551

[45] Dec. 30, 1980

[54] ENVIRONMENTALLY SEALED ROCKER SWITCH

[75] Inventor: Richard W. Sorenson, Avon, Conn.

[73] Assignee: Carlingswitch, Inc., West Hartford, Conn.

[21] Appl. No.: 39,859

[22] Filed: May 17, 1979

Related U.S. Application Data

[63] Continuation-in-part of Ser. No. 945,520, Sep. 25, 1978, abandoned.

[51] Int. Cl.[3] ..... H01H 9/04; H01H 9/16

[52] U.S. Cl. ..... 200/302; 200/315; 200/331; 200/339

[58] Field of Search ..... 200/68, 239, 243, 244, 200/302, 293, 310, 315, 331, 333, 339

[56] References Cited

U.S. PATENT DOCUMENTS

| | | | |
|---|---|---|---|
| 2,961,505 | 11/1960 | Alio et al. | 200/68 |
| 3,051,803 | 8/1962 | Brown | 200/243 |
| 3,169,172 | 2/1965 | Hagberg | 200/68 |
| 3,250,887 | 5/1966 | Sorenson | 200/339 |
| 3,294,932 | 12/1966 | Barlow | 200/68 |
| 3,320,380 | 5/1967 | Groves et al. | 200/243 |
| 3,403,236 | 9/1968 | Zoludow | 200/68 |
| 3,609,268 | 9/1971 | Sanchez | 200/315 |
| 4,013,857 | 3/1977 | Tanaka | 200/315 |
| 4,064,380 | 12/1977 | Matthews | 200/315 |

FOREIGN PATENT DOCUMENTS

| | | | |
|---|---|---|---|
| 1218581 | 6/1966 | Fed. Rep. of Germany | 200/68 |

*Primary Examiner*—John W. Shepperd

*Attorney, Agent, or Firm*—McCormick, Paulding & Huber

[57] ABSTRACT

A rocker switch housing has an upwardly open base, and a recessed cover secured to the base and defining a central upstanding boss for pivotally receiving an actuator. Aligned openings in the side walls of the recessed cover pivotally receive a manually movable rocker. The rocker is connected to the actuator, and loosely received in the recess, having a rectangular shape similar to that of the recess. The rocker may optionally have one or more transparent panels to provide light from one or more small lamps mounted in small openings in the recess of the cover to provide an indication of circuit condition. The two-part housing provides an environmentally sealed space for the switch contacts and for the electrical connection to the lamp.

10 Claims, 9 Drawing Figures

ENVIRONMENTALLY SEALED ROCKER SWITCH

CROSS REFERENCE TO RELATED APPLICATION

This application is a Continuation-In-Part of Ser. No. 945,520 filed Sept. 25, 1978, now abandoned.

SUMMARY OF INVENTION

This invention relates generally to electric rocker switches, and deals more particularly with an environmentally sealed rocker switch housing wherein the electrically conductive fixed and movable contacts are isolated from environmental contaminates introduced to the area of the manually movable rocker.

The housing comprises an upwardly open base for housing these contacts, which base may be formed from a dielectric thermoplastic material such as nylon or may be formed of bakelite. A cover of similar material has integrally formed depending legs which engage recesses provided for this purpose in the base and these legs define resilient upwardly projecting wings. The cover has a rectangular recessed portion for receiving a rocker and aligned openings in the side walls of the recessed portion. The rocker has laterally aligned tabs received in these side walls openings of the recessed cover, and the cover has a central boss to receive a spherically shaped portion of an actuator such that the actuator can move pivotally on the same axis as the rocker. One or more spring biased plungers on the lower end of the actuator engage the movable contact member or members, and the upper end of the actuator is directly connected to the rocker for changing the electrical condition of the switch. This construction provides an impervious upper boundary for the cavity containing the contact elements and the actuator plunger springs. Raised annular ribs may be formed alongside the centrally located boss for the actuator to provide one or more locations in the impervious recessed cover portion which can be stamped out or instantly formed open for mounting small lamps or LED's to indicate switch condition. The rocker may have one or more transparent cover panels above such lamps to provide indication of one or more switch conditions.

DESCRIPTION OF THE PREFERRED EMBODIMENT (FIGS. 1-4)

Figure 2:
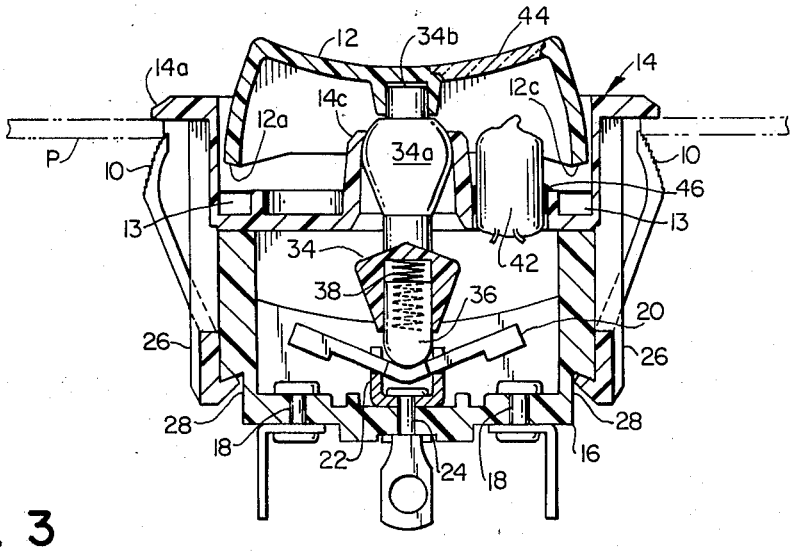
FIG. 2 is a sectional view taken generally on the line 2—2 of FIG. 1, with phantom lines to represent the panel in which the switch is adapted to be mounted.

Turning now to the drawings in greater detail, the switch of the present invention is intended to be secured in an opening provided for this purpose in a mounting plate or the like as suggested by the phantom lines P in FIG. 2 and the reader is referred to my prior U.S. Pat. No. 3,706,869 for a detailed discussion of the advantages to be gained by providing a switch housing of thermoplastic material such as nylon in order to provide integrally formed resilient wings as illustrated at 10, 10 in order to secure the switch housing in such an opening. However, it should be noted that the U.S. Pat. No. 3,706,869, and prior art patents generally, suffer from the disadvantages that such a switch configuration does not eliminate liquid contaminates being introduced into the interior of the switch case or housing. In these prior art switch configurations the rocker may not be constructed to fit tightly enough to prevent contaminants, particularly those of the liquid variety entering the interior of the switch housing by way of the front panel mounted actuating surface of the switch. Such contaminants often render the contacts useless or short circuit the switch mechanism.

It is a feature of the present invention that the rocker 12 is provided in a unique recessed cover bracket 14 which bracket cooperates with an upwardly open base 16 such that the interior cavity for these electrical contacts, and other metal parts of the switch, will not be attacked by these contaminants.

Figure 3:
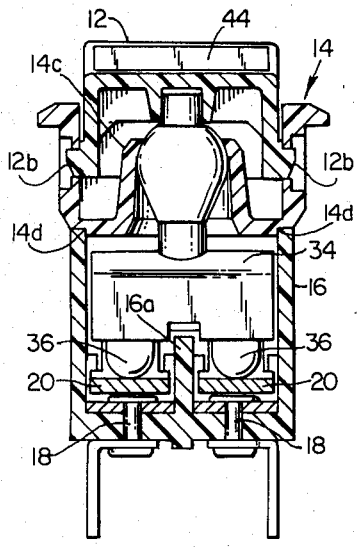
FIG. 3 is a sectional view taken generally on the line 3—3 of FIG. 1.

As best shown in FIG. 3, the base 16 comprises an upwardly open plastic part which has parallel side and end walls, and which may include a short center wall **16*a* integrally formed in the floor, and connecting the opposite end walls to shield the contacts in a double pole type switch such as that illustrated here. The contacts provided in the lower wall or floor of the base 16 may be of conventional configuration, and comprise studs 18, 18 secured in conventional fashion to the floor of the housing 16 and adapted to provide a conductive path from outside of the switch housing to the fixed contacts defined by the upper ends of the studs so that contact can be made between these fixed studs and one or more movable contact bridging members or levers 20. The bridging member or lever 20 is provided on a conductive yoke 22 held in the floor of the case 16 by a smaller stud 24 such that the switch itself may have three positions, a neutral position as shown, and alternative positions where the center yoke 22 is electrically connected to one or the other of the fixed contacts associated with each of the bridging members 20, 20**. A detailed discussion of the operation of the contact elements of the combination is deemed to be unnecessary in view of the conventional aspects for this portion of the present disclosure.

Figure 4:
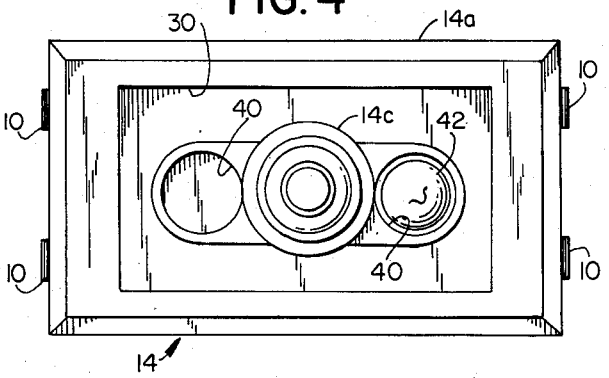
FIG. 4 is a plan view of the rocker switch illustrated in FIGS. 1 through 3, but with the rocker element removed in order to illustrate the configuration of the recessed cover to better advantage.

Turning now to a more complete description of the cover bracket 14, FIG. 4 shows this member to be of generally rectangular configuration slightly larger in size than the rectangular base upon which it fits, and having depending resilient legs 26, 26 (best shown in FIG. 2) which legs have inturned end portions for securing the cover bracket to the base by means of the recesses 28 provided for this purpose adjacent the lower side portions of the base. These depending legs 26, 26 each include a center bar 25 which is integrally connected to the upper portion of the cover bracket 14 and each leg 26 also include spaced wings 10, 10 as described above.

The cover 14 further comprises an upwardly open receptacle such that its floor provides a recessed portion with respect to the flanged peripheral portion 14*a*, and this recess is generally rectangular as indicated generally by reference numeral 30 in FIG. 4. FIG. 2 shows this recess to be deep enough such that it accommodates a major portion of the rocker 12 and provides room for the rocker to pivot from the position shown to alternative switch positions limited only by the abutment between the lower outer edge portions 12*a* and 12*c* of the rocker 12 against the upwardly facing adjacent surfaces of the recessed center portion of the cover bracket 14. The rocker 12 is pivotally supported in the cover bracket 14 for this purpose by means of projecting tabs 12*b*, 12*b* which tabs are received in aligned openings provided for this purpose in the side walls of the recess defining cover portion 14. The cover bracket 14 is snugly received in the upper end of the base 16 and held in place by the depending legs 26, 26 described above such that the interior of the base is isolated from the environment outside of the switch save only for a central opening provided in the cover bracket 14, and more particularly that defined by the upstanding cylindrical boss 14*c* defined in the cover and illustrated to best advantage in FIG. 4. This cylindrical boss 14*c* is adapted to receive an actuator 34 and more particularly a generally spherical portion of the actuator such that the actuator sealingly engages an inturned peripherally extending lip on the upper end of the boss 14*c*. The actuator is thus provided in this boss as a result of the lower end of the actuator having spring biased plungers 36, 36 for engagement with the movable contact bridging members or levers 20, 20. The actuator 34 is held in the position shown by these plungers and as long as the contact bridging member 20 remains in position, so too will the plungers 36, 36 and associated springs 38, 38. As so constructed and arranged the boss 14*c* is effectively sealed by the spherical portion of the actuator 34*a*. If liquid should be allowed to run into the recessed portion of the cover bracket none would penetrate the interior of the switch housing due to the spherical pressure seal between 14*c* and 34*a*. Any liquid reaching the recessed portion could be drained outside the switch assembly through optional ports 13, 13.

The uppermost end of the actuator 34 is provided with a short cylindrical stud 34*b* adapted to be received in a downwardly open cylindrical recess provided for this purpose in the underside of the rocker 12. Thus, once assembled, and the tabs 12*b*, 12*b* are received in their associated openings, rocker 12 and actuator 34 will be secured together for movement about a common pivot axis defined by the aligned openings in the cover bracket and also as defined by a lateral axis through the center of the spherical portion 34*a* of the actuator.

In summary then, the electric switch housing comprises an upwardly open dielectric base 16 for housing the movable contact bridging member 20 together with its yoke 22 and associated stud 24, and also for housing the fixed contacts 18, 18 all of which contacts may be so arranged as to provide a double pole switch as best shown in FIG. 3. The upper boundary of the cavity within which these contacts are mounted is defined by the underside of the cover bracket 14 characterized by a recessed center portion which is spaced below the flanged portion 14*a* of this cover bracket in order to provide a recess or well below the surface of the panel P in which the switch housing is adapted to be mounted by wings 10, 10 provided for this purpose on depending legs 26 of the cover bracket. It is an important feature of the present invention that the generally cylindrical upstanding boss 14*c* is defined centrally of this recessed portion of the cover bracket, and that the spherical upper end portion of the actuator 34 is snugly received for pivotal movement in a central opening of said boss 14*c*. The inner end of the actuator 34 defines downwardly open cavities in which spring loaded plungers 36, 36 are provided for engaging the movable contact bridging members 20, 20 respectively. The actuator 34 includes a widened lower portion in the double pole switch arrangement shown, and it is another feature of this actuator that its lateral width (as best shown in FIG. 3) is such that the actuator will be restricted to pivotal movement only about the axis defined by the spherical upper end portion 34*a* and more particularly by the axis of the aligned openings in the cover bracket which receive the tabs 12*b*, 12*b*. The upper end of the actuator 34 projects slightly above the boss 14*c*, so as to be received in a recess defined for this purpose in the rocker 12. The cover bracket further includes a peripherally extending flange portion 14*a* integrally connected to the recessed portion by the vertically extending wall portion mentioned previously, and this flanged portion 14*a* of the cover bracket cooperates with the upper free end portion of the wings 10, 10 so as to secure the assembled switch housing in a panel opening or the like. It will be apparent that the recessed portion of the cover bracket 14 is generally rectangular as best shown in FIG. 4, and that the boss 14*c* is cylindrical in configuration as there shown.

It is a further feature of the present invention that annular ribs 40, 40 may be provided alongside the cylindrical boss 14*c*, and that these annular ribs define central recesses located on the longer of the two symmetry axes associated with the rectangular cover bracket 14 such that convenient knock-out areas are provided to permit assembling small lamps or LED's in one or both of these openings as shown to best advantage in FIG. 2. The lamps or LED's may be mounted upright in one of these circular recesses simply by cutting away or knocking out a portion of the cover bracket as shown. Alternatively, the recessed rectangular portion may be provided with a circular opening when molded; and the ribbed portions 40, 40 may or may not be required. The open gap encircling the lamp(s) 42 is sealed by a potting compound 46 as suggested in FIG. 2. The lamp(s) or LED(s) is electrically connected to appropriate terminals in the floor of the switch housing so as to cause illumination of the lamp(s) in response to a predetermined electrical condition of the switch. When a lamp or LED of this type is provided in a switch of the present invention, the rocker 12 may be provided with a transparent panel 44 such that the illumination from the lamp 42 can be readily seen by an observer. This construction permits the transparent panel to be made of varying color depending on the purpose of the switch, and also to distinguish one side of the switch from the other when two lamps are provided in each of the recessed openings on either side of the boss 14*c*. In such a case, a second transparent panel would be provided in the opposite side of the rocker 14 and two different colors might be used for the switch while utilizing lamps or LED's of the same illumination color.

Another important feature of the present invention resides in the fact that the rocker 14 can be easily snapped into position at assembly, or can be removed from its assembled position shown as a result of spreading the longer side walls of the rectangular cover bracket in order to provide clearance between one end of a tab 12*b* and its associated opening defining wall. This particular advantage will allow a distributor of switches to stock fewer switches than might otherwise be required not only because he can assemble rocker actuators of different color or configuration with or without different color or pattern lenses.

DESCRIPTION OF ALTERNATIVE EMBODIMENTS (FIGS. 5, 6, & 7)

Figure 5:
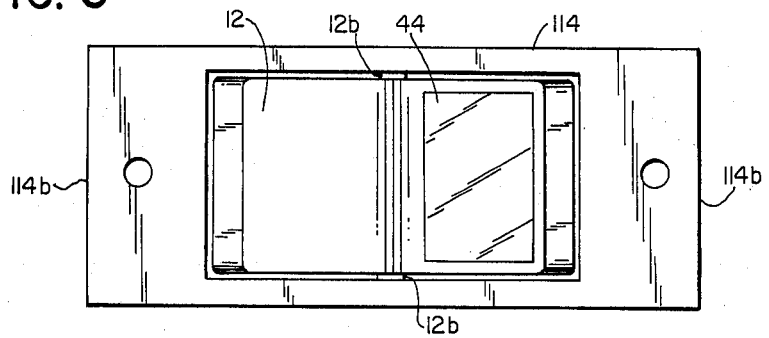
FIG. 5 is a plan view of an alternative embodiment of a rocker switch constructed in accordance with the present invention.
Figure 6:
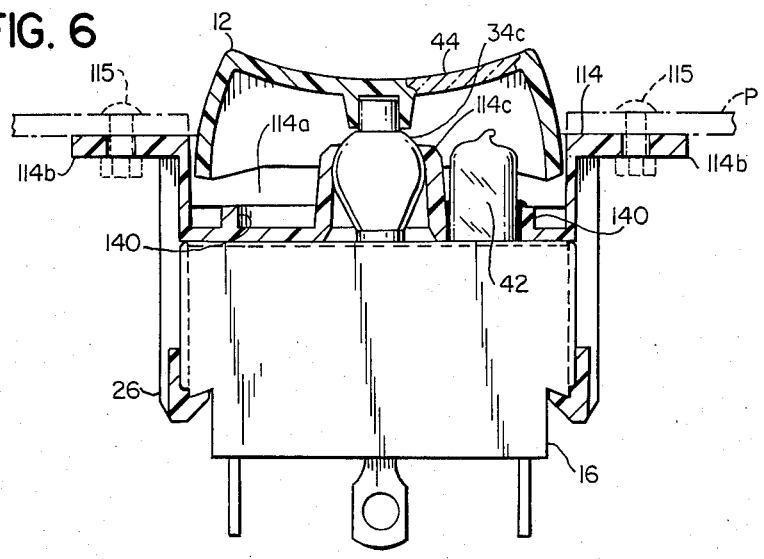
FIG. 6 is an elevational view, partly in section, of the FIG. 5 switch.
Figure 7:
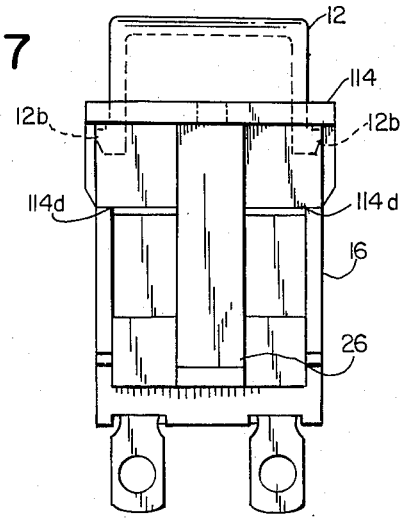
FIG. 7 is an end view of the rocker switch depicted in FIG. 5.

The alternative embodiment of FIGS. 5, 6, and 7 shows a base 16 identical to that shown in FIGS. 1–4 and having internal fixed and movable contacts (not shown) identical to those described above with reference to FIGS. 1–4. The actuator 34 shown in FIG. 6 is also identical to that described previously, and the rocker 12 is also identical to that of FIGS. 1–4. In place of cover bracket 14 of the preferred embodiment, I have shown a slightly different cover bracket 114, which also has a recessed floor deep enough to accommodate a major portion of rocker 12 and to pivotally support tabs 12*b*, 12*b* in aligned openings defined in the longitudinal side walls 114*a*, 114*a*.

The cover bracket 114, like that described above, also has a central boss 114*c* to receive the generally spherical portion 34*a* of actuator 34. So too, annular ribs 140, 140 may be provided alongside this boss 114*c* to provide convenient knock-out areas or openings for receiving small lamps or LED's as shown.

The cover bracket 114 is unlike cover 14 of FIGS. 1–4, however, in that alternative means is provided for mounting the assembled rocker switch in a panel opening. Instead of the wings 10, 10 of FIG. 2, I provide projecting flanges 114*b*, 114*b* at the upper edges of the end walls to abut the underside of such a panel, and fasteners 115, 115 to secure the assembled rocker switch in the panel opening. Thus many of the advantages listed above for the rocker switch of FIGS. 1–4 are also obtained with the FIGS. 5, 6 and 7 version, especially as to the isolation of the switch contacts.

Figure 1:
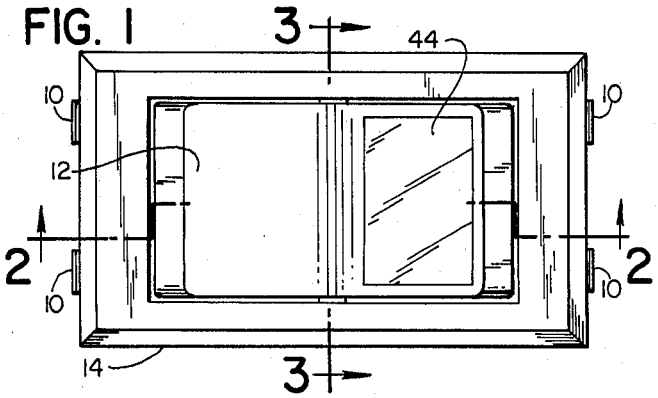
FIG. 1 is a top plan view of a rocker switch constructed in accordance with the present invention.

The cover bracket 114 is, however, held to the base 16 by depending legs 26, 26 integrally formed therein, but no wings such as those shown at 10, 10 in FIG. 1 are provided on this version to mount the switch in the panel P. The above-described fasteners 115, 115 in flanges 114*b*, 114*b* are used for this purpose. However, the base 16 does have longitudinally extending sides extending upwardly into recesses 114*d*, 114*d* defined in the underside of the cover bracket for this purpose, and preventing relative lateral movement therebetween. FIG. 3 shows such recesses 14*d*, 14*d* to better advantage in reference to the cover bracket 14.

DESCRIPTION OF FIGS. 8 & 9

In both embodiments described above, a lamp 42 or LED is provided in an opening 40 (or 140) of the switch cover bracket, 14 and 114 respectively, to provide a visual indication of the electrical condition of the switch. The unique construction of this cover bracket configuration and the well or recess provided for the rocker 12, together with the upstanding central boss with its parti-spherical bearing for snugly receiving the actuator 34, provides a waterproof switch which will not admit liquids to the interior thereof, even when a lamp is added to the combination as described above. Whereas, I have described the lamp 42 as epoxied in one or the other of the openings 40 and 140 of cover brackets 114, 114 respectively, I have recently devised an improved lamp configuration which does not require potting the lamp or LED at assembly of the electrical switch components.

Figure 8:
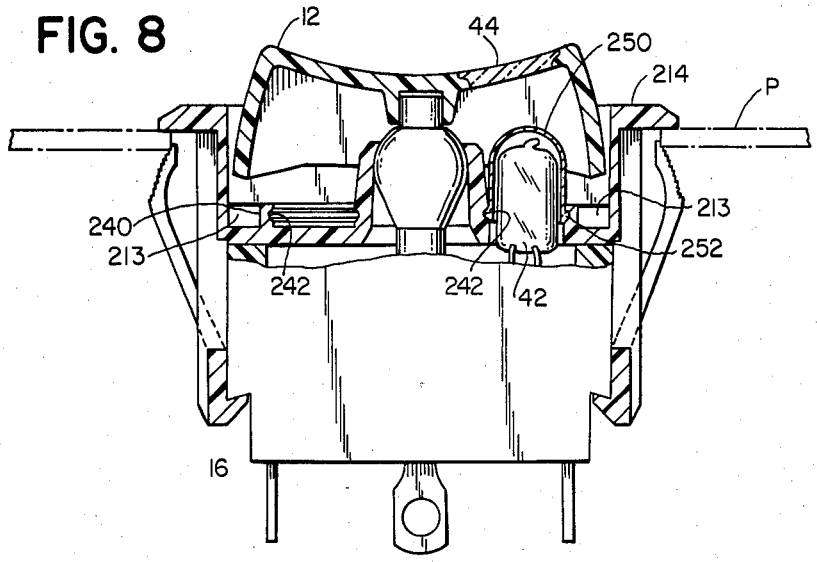
FIG. 8 is a side elevational view of a switch similar to that shown in FIG. 2 above, and illustrating the upper portion in vertical section to reveal a different indicator lamp configuration.

FIG. 8 shows a lamp 42 held in place by nothing more than the wires which provide it with electrical energy from certain of the terminals shown at the bottom of the base 16. The cover bracket 214 is identical to that described above, by reference to member 14 in FIGS. 1–4, except for the provision of an annular groove 242 in each annular rib 240 (otherwise similar to the ribs 40 and 140 in FIGS. 2 and 6 respectively).

Figure 9:
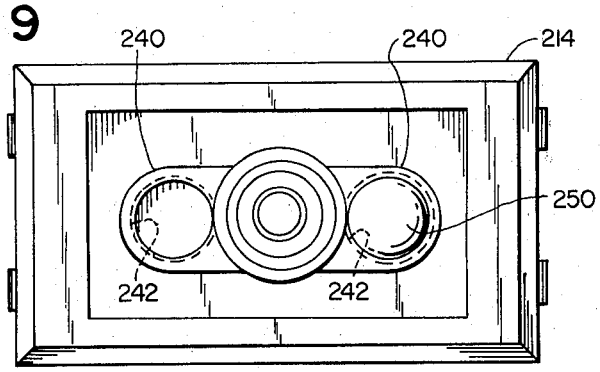
FIG. 9 is a plan view of the switch and associated lamp configuration depicted in FIG. 8.

Finally, and still with reference to FIGS. 8 and 9, I have maintained the waterproof feature of this switch configuration by providing a domed lens 250 in the annular ribbed portion 240 of the recess in the cover bracket 214 which has been fitted with the lamp 42. The domed lens 250 preferably has an external annular rib 252 which is received in an inwardly open annular groove 242 provided for this purpose when each cover bracket is molded (see the left-hand side of FIGS. 8 and 9 for this feature of bracket 214 wherein no lamp or lens is installed, but where the floor of the recessed portion is, nevertheless intact because no hole has yet been formed in the annular ribbed portion to receive such a lamp). The above described snap-in style dome lens is the presently preferred configuration, but other constructions might also be utilized. For example, the lens might be ultrasonically welded in place at assembly, or might be potted in place as described above with reference to the lamp 42 in FIGS. 2 and 6.

Thus, the switch of FIGS. 8 and 9 provides an environmentally sealed space for the switch contacts and other electrical components (such as lamp 42) and any liquids entering the space behind or below the rocker 12 will not enter this sealed space, but will drain outwardly through openings 213, 213 provided for this purpose in the peripherally extending wall portion of the cover bracket 214.

I claim:

1. An electric switch housing for protecting the fixed contacts and movable contact bridging member from environmental conditions external to the switch, said housing comprising an upwardly open dielectric base for said contacts and bridging member, a dielectric cover bracket secured to said base for isolating the contents of the base from the environment, said cover bracket having a recessed portion and a generally cylindrical upstanding boss defined centrally of said recessed portion, an actuator snugly received in a central opening of said boss and having a shoulder portion engaging an inturned lip on said boss, an inner end of the actuator adapted to engage the movable contact bridging member and an upper end of said actuator projecting above the lip of said boss, said cover bracket having a raised peripherally extending wall portion, said wall portion having aligned openings therein, which openings are also aligned with a diameter of the upper portion of said cylindrical boss, and a rocker with laterally projecting tabs pivotally received in said aligned openings and having a center portion for receiving said upwardly projecting end of said actuator.

2. The switch housing of claim 1 wherein said actuator shoulder comprises a generally spherical portion adjacent said upper end and is snugly received in a complementary shaped upper end of said boss defined by said lip, and said spherical portion of said actuator having its geometric center in alignment with said projecting tabs on said rocker.

3. The switch housing of claim 2 wherein said actuator includes a lower portion having at least one plunger slidably received in a downwardly open recess, and biasing means acting between said plunger and said actuator, said actuator having an intermediate portion so shaped that it cooperates with the interior of said base to restrict the actuator to pivotal movement about said spherical center and thereby for pivotal movement with respect to the rocker pivot axis defined by said aligned openings.

4. The switch housing of claim 3 wherein said recessed portion of said cover bracket is of generally rectangular configuration to conform generally to the rectangular configuration of said rocker, and at least one raised rib of generally annular configuration in said recessed portion of said cover bracket to define a circular opening which can receive a small electric lamp of cylindrical configuration, and a light transparent panel one side of said rectangular rocker to indicate switch position when the lamp is lit.

5. The switch housing of claim 3 wherein said cover has depending resilient legs which cooperate with recesses defined in the exterior of said base in order to secure the base and cover to one another and wherein said wall portion includes an upper peripherally extending flanged portion integrally connected thereto.

6. The switch housing of claim 3 wherein said cover bracket has integrally formed depending legs at opposite ends thereof, which legs cooperate with recesses in said base to secure said base to said cover bracket, and said legs having integrally formed wings to engage the underside of a panel in which the switch is to be mounted, said cover bracket having flanged portions spaced from the free end of said wings to engage the front side of the panel to hold the switch housing in a panel opening.

7. The switch housing of claim 3 wherein said cover has at least two projecting flanges at opposite ends thereof, said flanges integrally connected to said wall portion thereof, and said cover having depending resilient legs which cooperate with recesses defined in the exterior of said base to secure the base and cover to one another.

8. The switch housing of claim 1 wherein said recessed portion of said cover bracket is of generally rectangular configuration and conforms generally to a generally rectangular configuration of said rocker, at least one opening in said recessed portion of said cover bracket alongside said boss to receive a small electric lamp.

9. The switch housing of claim 8 further characterized by a dome shaped lens having a base fit snugly in said one opening in said recessed portion of said cover bracket, said lamp received at least partially inside said dome shaped lens.

10. The switch housing of claim 9 wherein said lens base defines an annular rib snuggly received in an annular groove defined by said one opening of recessed cover portion.

* * * * *